US006253672B1

(12) United States Patent
Rauf et al.

(10) Patent No.: US 6,253,672 B1
(45) Date of Patent: Jul. 3, 2001

(54) HYDRAULIC PLATEN PRESS

(75) Inventors: Heinrich Rauf, Willich; Götz Sondermann, Kempen, both of (DE)

(73) Assignee: G. Siempelkamp GmbH & Co., Krefeld (DE)

( * ) Notice: Subject to any disclaimer, the term of this patent is extended or adjusted under 35 U.S.C. 154(b) by 0 days.

(21) Appl. No.: 09/420,112

(22) Filed: Oct. 18, 1999

(30) Foreign Application Priority Data

Oct. 16, 1998 (DE) ..... 198 47 890

(51) Int. Cl.[7] ..... B30B 1/34

(52) U.S. Cl. ..... 100/269.06; 100/269.14; 100/269.08; 100/269.1; 72/453.06; 72/453.08

(58) Field of Search ..... 100/269.06, 269.07, 100/269.08, 269.1, 269.14, 199, 216, 257; 72/453.06, 453.07, 453.08

(56) References Cited

U.S. PATENT DOCUMENTS 1,891,121 * 12/1932 Thoreson ..... 100/269.08
2,484,908 * 10/1949 Purcell ..... 100/269.1
2,980,013 * 4/1961 Swick et al. ..... 100/269.08
3,343,217 * 9/1967 Daubenberger ..... 100/269.08
3,526,188 * 9/1970 Carlsson ..... 100/269.08
4,157,066 * 6/1979 Pretty ..... 100/269.08
4,492,154 * 1/1985 Rupp et al. ..... 100/269.06
5,379,628 * 1/1995 Pahnke et al. ..... 100/269.07
5,634,398 * 6/1997 McGee et al. ..... 100/199
5,690,025 * 11/1997 Hawkins ..... 100/269.07
5,735,201 * 4/1998 Hirao et al. ..... 100/269.14
5,823,104 * 10/1998 Beisel et al. ..... 100/269.14

* cited by examiner

*Primary Examiner*—Peter Vo
*Assistant Examiner*—Louis K. Huynh
(74) *Attorney, Agent, or Firm*—Herbert Dubno; Andrew Wilford

(57) ABSTRACT

A press has a fixed platen, a movable platen displaceable toward and away from the fixed platen, a plurality of low-pressure cylinders braced against the movable platen and pressurizable to move it toward the fixed platen, and a plurality of medium-pressure cylinders braced against the movable platen and pressurizable to move it toward the fixed platen. A low-pressure accumulator holding a body of hydraulic fluid and a head of nitrogen and a medium-pressure accumulator holding a body of hydraulic fluid and a head of nitrogen are connected via respective conduits with the low- and medium-pressure cylinders. a nitrogen supply connects the accumulators above the respective fluid bodies together in a closed system. A controller feeds the fluid therefrom to the respective cylinders. More particularly, the nitrogen supply includes a shunt conduit extending between upper regions of the accumulators and a pump or compressor in the shunt conduit for displacing nitrogen from the low-pressure accumulator to the high-pressure accumulator.

4 Claims, 1 Drawing Sheet

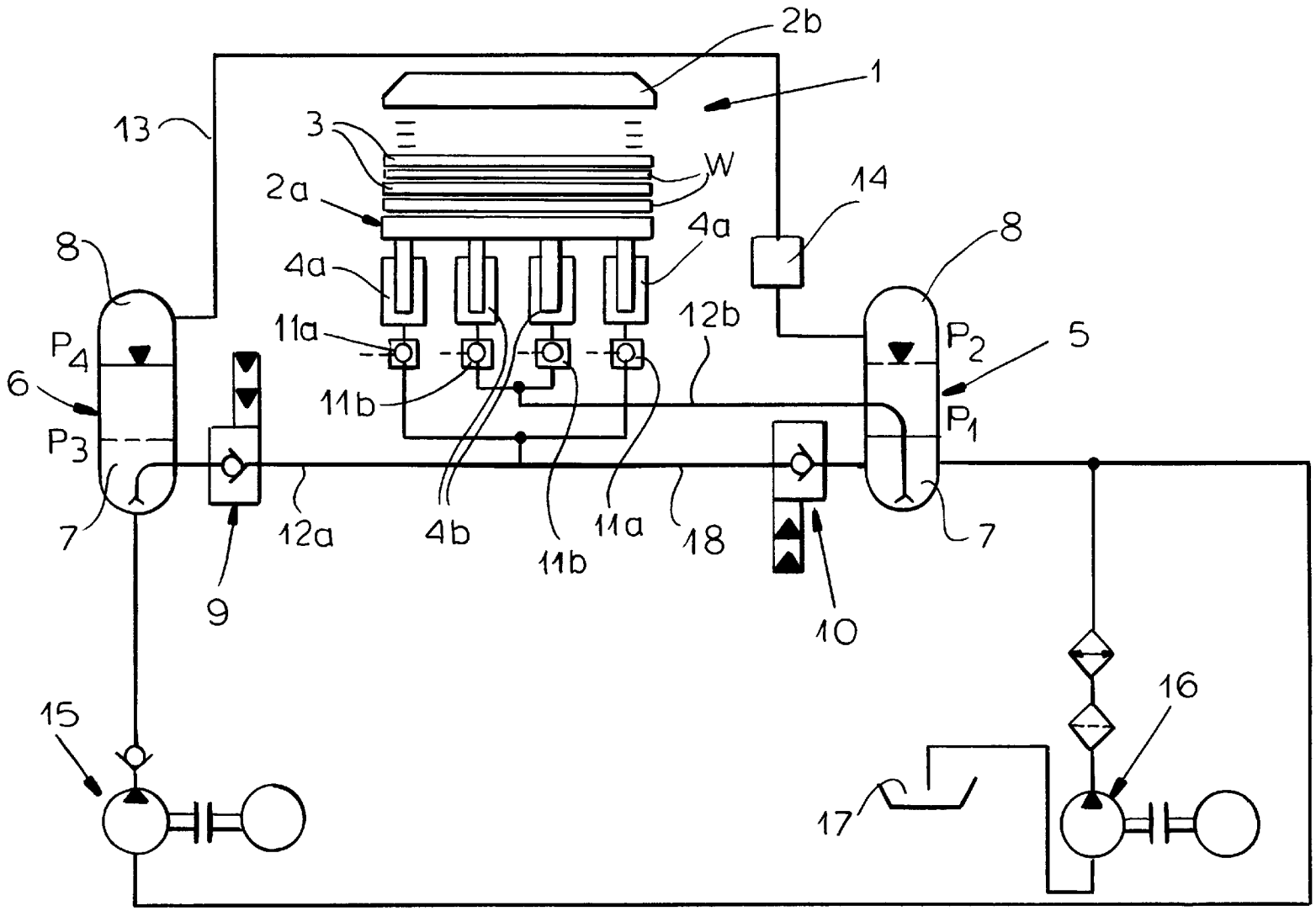
1
2b
2a
3
W
4a
4a
4b
5
6
7
7
8
8
9
10
11a
11a
11b
11b
12a
12b
13
14
15
16
17
18
P1
P2
P3
P4

HYDRAULIC PLATEN PRESS

FIELD OF THE INVENTION

The present invention relates to a platen press. More particularly this invention concerns a hydraulically powered multistage platen press.

BACKGROUND OF THE INVENTION

In the production of plywood, chipboard, paneling, and the like a press is used having a pair of main outer platens between which can be sandwiched a plurality of panel workpieces alternating with intermediate platens. A plurality of heavy-duty hydraulic cylinders press one of the outer platens toward the other while the workpieces and intermediate platens are heated to compress and cure the workpieces.

U.S. Pat. No. 5,634,398 describe such a platen press with the actuating cylinders provided underneath the lower platen, the upper platen being fixed. Such an arrangement eliminates the need for double-acting cylinders since the weight of the press can serve to open it. Here there are separate low- and intermediate-pressure accumulators connected in a complex arrangement to different groups of the actuating cylinders.

The main problem with this arrangement is that it is very complex. Furthermore considerable of the nitrogen used as the head above the fluid in the accumulators is lost, in particular from the low-pressure accumulator as gas dissolved in the fluid devolves out as the pressure drops.

OBJECTS OF THE INVENTION

It is therefore an object of the present invention to provide an improved platen press.

Another object is the provision of such an improved platen press which overcomes the above-given disadvantages, that is which is of relatively simple construction and that does not waste hydrogen from the accumulators.

SUMMARY OF THE INVENTION

A press has according to the invention a fixed platen, a movable platen displaceable toward and away from the fixed platen, a plurality of low-pressure cylinders braced against the movable platen and pressurizable to move it toward the fixed platen, and a plurality of medium-pressure cylinders braced against the movable platen and pressurizable to move it toward the fixed platen. A low-pressure accumulator holding a body of hydraulic fluid and a head of nitrogen and a medium-pressure accumulator holding a body of hydraulic fluid and a head of nitrogen are connected via respective conduits with the low- and medium-pressure cylinders. According to the invention a nitrogen supply connects the accumulators above the respective fluid bodies together in a closed system. A controller feeds the fluid therefrom to the respective cylinders. More particularly, the nitrogen supply includes a shunt conduit extending between upper regions of the accumulators and a pump or compressor in the shunt conduit for displacing nitrogen from the low-pressure accumulator to the high-pressure accumulator.

Thus with this system there is no loss of nitrogen at all. The nitrogen that is dissolved in the hydraulic fluid and that devolves out of it when the pressure on the fluid is reduces is recycled back to the accumulator under higher pressure. It is therefore possible to reduce the size of the intermediate-pressure accumulator since the press is not closed only by a first group of cylinders connected with this intermediate-pressure source. The low-pressure cylinders bear continuously on the platen and can serve principally to cancel out its weight.

The medium-pressure cylinders flank the low-pressure cylinders. Thus for example two medium-pressure cylinders at the leading and trailing end of the lower platen can flank four low-pressure cylinders arranged centrally under the lower movable platen.

The control means include a valve in the medium-pressure conduit and a valve and shunt between the low- and medium-pressure conduits. Two-stage valves that open incrementally are used according to the invention.

BRIEF DESCRIPTION OF THE DRAWING

The above and other objects, features, and advantages will become more readily apparent from the following description, reference being made to the accompanying drawing whose sole FIGURE is a schematic representation of the press according to the invention.

SPECIFIC DESCRIPTION

As seen in the drawing a platen press 1 has outer platens 2*a* and 2*b* that sandwich a plurality of intermediate platens 3 and workpieces W. The upper platen 2*b* here is fixed and the lower platen 2*a* is vertically movable by a system of four outer hydraulic cylinders 4*a* and four inner hydraulic cylinders 4*b* having respective control valves 11*a* and 11*b* connected to respective conduits 12*a* and 12*b*.

A low-pressure accumulator 5 and an intermediate-pressure accumulator 6 each contain a body 7 of hydraulic fluid underneath a head 8 of nitrogen. The low-pressure accumulator 5 is pressurized by a respective pump 16 to more than a predetermined minimum pressure $P_1$ and less than a predetermined maximum pressure $P_2$. The intermediate-pressure accumulator 6 is pressurized by a respective pump 15 to more than a predetermined minimum pressure $P_3$ greater than the pressure $P_2$ and less than a predetermined maximum pressure $P_4$. The accumulator 6 is connected via the line 12*a* and a control valve 9 to the valves 11*a* of the cylinders 4*a* and the accumulator 5 is connected via the line 12*b* directly to the valves 11*b* of the cylinders 4*b*. These valves 11*a* and 11*b* can be three-position four-port valves that in one end position connect the respective actuators 4*a* or 4*b* to the respective line 12*a* or 12*b*, in a central position block all flow into or out of the cylinders 4*a* and 4*b*, and in another end position connect the respective cylinders 4*a* and 4*b* to a sump 17. A shunt line 18 extends from the line 12*a* to the medium-pressure accumulator 7 and is provided with a control valve 10.

According to the invention a conduit 13 extends between upper regions of the accumulators 5 and 6 and is provided with a compressor 14 so that nitrogen can be drawn from the head 8 of the low-pressure accumulator 5 and fed to the head 8 of the medium-pressure accumulator 6. Thus none of the nitrogen that devolves from the body 7 in the accumulator 5 is lost.

The press is closed by opening the valves 9 and 11*a* so as to pressurize the outer cylinders 4*a*. The hydraulic fluid flows from the intermediate accumulator 6 at pressure $P_4$ to these cylinders 4*a*. Since the pressure of the low-pressure accumulator 5 is at its starting level $P_2$ and is always applied to the inner cylinders 4*b*, the inner cylinders 4*b* are automatically prefilled for closing of the press 1. Thus the pistons of the inner cylinders 4*b* always bear on the press plates 2*a*.

When the press 1 is closed the pressure in the accumulator is set at $P_3$ and in the accumulator 5 at $P_1$.

To open the press 1 after a completed pressing and decompression cycle the cylinders 4*b* are decompressed back into the accumulator 5 by opening of the valves 11*b* and 10 so that the static weight of the press and associated equipment brings the pressure in the accumulator 5 back up to the pressure $P_2$. The pressure vented from the cylinders 4*a* is fed back to the accumulator 5 on opening of the press 1 via the shunt 18 between the lines 12*a* and 12*b*.

We claim:

1. A press comprising:

a fixed platen; a a movable platen displaceable toward and away from the fixed platen;

a plurality of low-pressure cylinders braced against the movable platen and pressurizable to move it toward the fixed platen;

a plurality of medium-pressure cylinders braced against the movable platen and pressurizable to move it toward the fixed platen;

a low-pressure accumulator holding a body of hydraulic fluid and a head of nitrogen;

a medium-pressure accumulator holding a body of hydraulic fluid and a head of nitrogen;

respective conduits connecting the low- and medium-pressure accumulators with the low- and medium-pressure cylinders;

means including a nitrogen supply for connecting the accumulators above the respective fluid bodies together in a closed system;

control means for feeding the fluid therefrom to the respective cylinders.

2. The press defined in claim 1 wherein the nitrogen-supply means includes:

a shunt conduit extending between upper regions of the accumulators; and pump means in the shunt conduit for displacing nitrogen from the low-pressure accumulator to the high-pressure accumulator.

3. The press defined in claim 1 wherein the medium-pressure cylinders flank the low-pressure cylinders.

4. The press defined in claim 1 wherein the control means include a valve in the medium-pressure conduit and a valve and shunt between the medium-pressure conduit and the low-pressure conduit.

* * * * *